US005078963A

United States Patent [19]

Mallen

[11] Patent Number: 5,078,963

[45] Date of Patent: Jan. 7, 1992

[54] METHOD OF PREVENTING FIRES IN ENGINE AND EXHAUST SYSTEMS USING HIGH NICKEL MALLEN ALLOY

[76] Inventor: Ted A. Mallen, P.O. Box 1166, Cleveland, Tenn. 37311

[21] Appl. No.: 480,048

[22] Filed: Feb. 14, 1990

[51] Int. Cl.[5] ..... C22C 19/05; C22C 28/00

[52] U.S. Cl. ..... 420/443; 148/410

[58] Field of Search ..... 420/443; 148/410

[56] References Cited

U.S. PATENT DOCUMENTS

| | | | |
|---|---|---|---|
| 4,174,213 | 11/1979 | Fukui et al. | 420/451 |
| 4,400,210 | 8/1983 | Kudo et al. | 420/443 |
| 4,602,968 | 7/1986 | Bergmann et al. | 148/410 |
| 4,621,499 | 11/1986 | Mori et al. | 148/410 |
| 4,652,315 | 3/1987 | Igarashi et al. | 148/410 |
| 4,668,312 | 5/1987 | Benn et al. | 148/410 |

OTHER PUBLICATIONS

Federal Aviation Regulations, Airworthiness Standards: Normal, Utility and Acrobatic.

Emergency Airworthiness Directive, U.S. Department of Transportation, Jan. 5, 1990.

Aerostar Owners Association letter of Jan. 19, 1990.

*Primary Examiner*—Upendra Roy

*Attorney, Agent, or Firm*—Oblon, Spivak, McClelland, Maier & Neustadt

[57] ABSTRACT

High temperature internal combustion engine assembly components, exhaust assembly components and engine compartment components comprising a high temperature material and a method of preventing engine compartment fires.

8 Claims, 7 Drawing Sheets

METHOD OF PREVENTING FIRES IN ENGINE AND EXHAUST SYSTEMS USING HIGH NICKEL MALLEN ALLOY

BACKGROUND OF THE INVENTION

1. Field of the Invention

The present invention is directed to the novel use of a high temperature material in engine and exhaust system parts and a method of preventing fires resulting from exhaust system failure. More particularly, the invention is directed to engine and exhaust system parts and engine compartment parts for positive displacement engines, for example piston-driven engines.

2. Discussion of the Background

Aircraft safety is an important and critical aspect of modern aviation. Aircraft safety for both private aircraft and commercial aircraft is regulated by the Federal Aviation Administration (FAA). An important aspect of aircraft safety is the construction and maintenance of aircraft engine and exhaust system components in order to prevent engine fires and additional damage associated with engine fires. Aircraft fires of any type are a serious problem. Fires in the engine compartment and in the aft engine compartment cause particularly severe problems in aircraft in which the wing spar passes through or near the engine compartment. Engine fires occurring in such aircraft can result in failure of the wing spar and separation of the wing from the aircraft during flight.

In situations in which the wing spar does not collapse, engine compartment fires still represent a serious safety problem. A major cause of fire in the engine compartment is failure of engine or exhaust system components operating at high temperatures. Component failure is aggravated in engines where very hot exhaust gas is routed to additional engine components such as a turbocharger instead of being simply vented outside the engine compartment. In such situations, deterioration of engine and exhaust part can occur rapidly. Engine compartment fire is an extreme aircraft emergency for the following reasons.

1. The engine compartment contains many systems that can complicate a fire situation. These systems include the fuel, engine oil, hydraulic and electrical systems. The failure of a turbocharger exhaust assembly within the engine compartment allows extremely hot gases to directly contact and destroy the integrity of the systems contained in the engine compartment.

2. The standard pilot response to an engine fire includes the shutting down of the engine. The shutting down of an aircraft engine, even on a twin engine aircraft, creates a very serious engine-out situation in which the pilot must cope with a potentially underpowered aircraft, unbalanced thrust and additional drag factors. Loss of the engine in a single-engine plane can be a catastrophe. The loss of an engine contributes substantially to crashes based on the loss of the engine alone. The presence of an onboard engine fire greatly exacerbates this situation.

3. Engine fires have demonstrated the ability to freeze the engine controls so that the pilot cannot feather his engine. In this situation, the only way to shut off the engine is to cut off the magnetos and/or fuel selector switch. After the engine has been shut down, the prop will windmill thereby increasing drag and continue to pump oil out of any ruptured oil lines. Aircraft with lower power ranges are frequently unable to maintain altitude with a windmilling engine.

4. In some aircraft, a single engine runs the hydraulic system pump, although some planes are equipped with auxiliary electrical hydraulic pumps. A pilot under the stress of an engine fire may shut down the engine running the hydraulic system pump thereby losing hydraulic pressure necessary to operate the control surfaces of the aircraft. Landing gear will frequently lower under such circumstances due to the fail-safe design of such systems. Lack of control surfaces combined with the increased drag of a windmilling engine and lowered landing gear contribute to aircraft instability.

6. In twin engine aircraft, the wing spar is located in the aft engine compartment and contains fuel and oil lines. Fires in the engine compartment cause the firewall to fail, ultimately resulting in rupture of the oil and fuel lines.

7. Smoke caused by the fire can enter the aircraft cabin of pressurized twin aircraft by way of the engine through the bleed air system. Smoke in the engine compartment interferes with pilot vision further reducing aircraft safety and contributing to aircraft accidents.

In single engine aircraft, fire in the engine compartment may directly interfere with the pilot's vision. Alternatively, smoke from engine compartment fires can easily enter the cockpit interfering with pilot vision and aircraft control. Damage to oil lines resulting from engine compartment fire can result in oil leaks with the possibility of oil on the windshield further reducing pilot vision and safety. Although there is generally no danger to the wing spar from an engine compartment fire in single engine aircraft, such fires are serious and life threatening to the pilot.

The critical nature of aircraft engine fires and exhaust system fires have been recognized by the FAA which has issued regulations and airworthiness directives (AD's) in an attempt to address exhaust system failures and safety. See for example Federal Aviation Regulation 23.1121, 23.1123 and 23.1125. With regard to some smaller turbocharged piston-engine aircarft, emergency air worthiness directives have been issued requiring the installation of fire detection kits to provide early warning of engine and exhaust system fires. See FAA-AD 90-01-02. In addition to actions by governmental agencies, private aircraft owners associations have also expressed concern with regard to engine and exhaust system failures and have attempted to address these problems.

Private aircraft associations in cooperation with the FAA have studied aircarft engine fires. Fires have been attributed, for example, to cracks occurring in the engine and exhaust system components, brackets and clamps and the firewall as a result of vibration. Additional stress occurs from repeated heating and cooling cycles of the engine and exhaust parts which are typically very hot during operation of the engine. Vibration and thermal stress are thought to contribute significantly to cracks occurring in the manifold and tailpipe assemblies as well as cracks in the associated flanges and brackets which secure the manifold and tailpipe assemblies to the engine, firewall or engine compartment. Loosening of the manifold and tailpipe assemblies due to vibration and heat stress can result in separation of the exhaust system from the engine itself. In such an event, the hot exhaust gases are no longer directed out of the engine compartment but directly contact the firewall and other engine components.

Proposed solutions to the thermal and vibration problems include a redesign of the engine and exhaust systems using heavier gauge materials, more secure attachment methods, secondary clamps and brackets to provide redundant fastening means to an existing tailpipe assembly, the installation of fire resistant hoses behind the firewall to further protect oil and fuel lines, the elimination of fuel and oil pressure lines altogether with electric gauging systems, the addition of flame deflector chutes to the firewall area and the application of intumescent coatings to the firewall to further prevent fire.

None of the proposed solutions to the problem of engine compartment fires, proposed by the FAA or by private groups have so far eliminated the problem of engine compartment fires. None of these solution have identified a critical feature of engine compartment fires and current engine and exhaust system construction. Without recognition of critical flaws in engine and exhaust assembly components, a solution to the problem of engine compartment fires cannot be achieved.

Clearly, any engine fire in a vehicle is a critically dangerous problem. Aircraft engine fires resulting from exhaust system failure of positive displacement aircraft engines are a serious problem to both private and corporate aviation. Although potential sources of the fires have been evaluated and numerous suggestions have been advanced by both the FAA and private groups, a need continues to exist for improved engine and exhaust systems and a method preventing engine compartment fires.

SUMMARY OF THE INVENTION

Accordingly, one object of the present invention is to provide engine compartment and exhaust system parts for positive displacement internal combination engines which do not suffer from the problems discussed above.

Another object is to provide such parts for positive displacement aircraft engines, and in particular for turbocharged piston-driven aircraft.

A further object is to provide a method for preventing engine and exhaust system fires in vehicles using high temperature piston engines.

These and other objects which will become apparent from the following specification have been achieved by invention of the present engine and exhaust system, engine and exhaust system parts, accessories and engine compartment components. Use of the present components substantially reduces the incidence of engine compartment fires due to engine and exhaust system failure.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
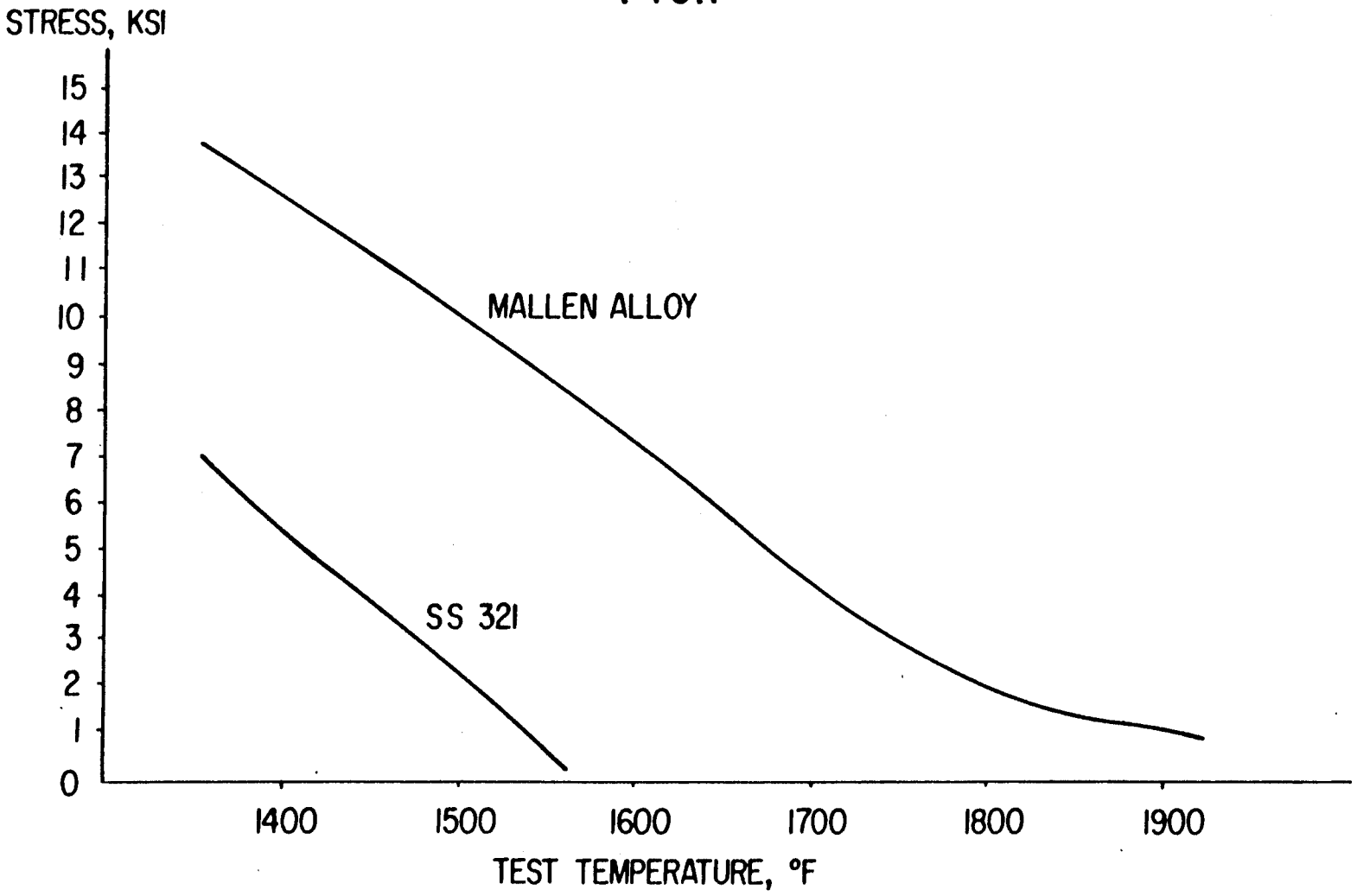
FIG. 1 shows a comparison of the creep properties of a preferred alloy used to make the components of the present invention compared with a conventional stainless steel (SS 321)

All of the solutions suggested by the prior art have failed to recognize that one critical problem in positive displacement engines which contributes to engine compartment fires is the material from which the engine and exhaust assemblies are fabricated. No one has recognized that in positive displacement engines, it is critical to use a material which is capable of withstanding operating temperatures of 1400° F. and higher so that one can prevent engine compartment fires. Without recognition of the underlying problem, the solution to the problem to which the present invention is directed, was unattainable. By recognizing the unique underlying problem associated with positive displacement engine and exhaust assemblies, Applicant has discovered a unique and valuable solution to the problem of engine compartment fires.

The present invention is directed to positive displacement internal combustion engines, and particularly exhaust systems, including associated clamps, brackets and accessories of such engines which reach temperatures greater than or equal to about 1400° F., alternatively up to 1500° F. and higher. This includes high performance automobile engines, aircraft engines, etc. Although the specific embodiments described below refer to aircraft components, it is to be understood that the scope of the present invention includes any positive displacement engine and exhaust system operating continuously or cycling, i.e., heating and cooling cycles, at temperatures greater than or equal to about 1400° F.

It has now been discovered after a careful and extensive study of failed aircraft parts and the available scientific information that it is possible to substantially prevent engine compartment fires in piston-driven aircraft by fabrication of certain aircraft components from high-temperature oxidation resistant materials. An examination of numerous failed exhaust system parts made from conventional stainless steel, such as SS 321, has shown that excessive oxidation scaling and cracking occur during routine operation of piston aircraft engines, and in particular with turbocharged piston engines.

One aspect of the invention, therefore, is the fabrication of conventional aircraft exhaust system components, engine components, turbochargers, clamps, brackets, etc., as well as engine compartment components such as the firewall from certain high temperature oxidation resistant materials. The engine and exhaust components of the present invention which are prepared from the materials described below are conventional engine, exhaust and engine compartment components and may have any conventional shape and design. The present components are interchangeable with those known components and can be installed by conventional means. All positive displacement engine, exhaust and engine compartment components which operate at temperatures of 1400° F. or above or which may be expected to be exposed to high tempratures in the event of exhaust gas leakage are within the scope of the present invention. Preferred engine components include valves, cylinders, pistons, crankcase, bearings, crankshafts, rings, camshafts, pushrods, rocker arms, engine bolts, exhaust ports, turbocharger housing and turbocharger components including turbine bearings and rotors, and clamps or brackets used to secure high temperature components to the engine. Preferred exhaust system components include the manifold, all exhaust pipes, bolts, tailpipes, turbocharger exhaust pipes, and wastegates as well as flanges on these parts and all brackets, clamps and safety wire used to secure the exhaust system components to the engine or to the engine compartment. Preferred engine compartment components to be fabricated from the alloy of the present invention include the firewall, oil, fuel, electrical and other lines, heat sensing probes and any clamping or securing means used to clamp or secure engine or exhaust components to the firewall.

Particularly preferred are engine components, exhaust components and engine compartment components used in connection with turbocharged piston-driven aircraft engines. The engine exhaust in turbocharged positive displacement engines is generally routed from the engine exhaust ports to the turbocharger within the engine compartment. Additional thermal stress is therefore present within the engine compartment of these vehicles. Accordingly, the need for high temperature oxidation resistant material parts is greater in turbocharged engines. By way of example, turbocharged engines are found, for example, on Piper Aircraft Corporation Models PA-60-601, PA-60-601P, PA-60-602P and PA-60-700P airplanes. Additionally, Ted Smith Aerostar Models 601, 601A, 601B and 601P airplanes having engine components, exhaust components and engine compartment components of the present invention are preferred.

Although virtually any component of the engine, exhaust or engine compartment assemblies may be prepared from the materials of the present invention, the present materials are generally more expensive than conventional stainless steels or aluminum and accordingly for economic reasons, it may be desired that only those parts which are subject to extremely high temperature stress be fabricated. In particular, the exhaust pipes, turbocharger components and clamps associated with the turbocharger exhaust assembly as well as the firewall can be fabricated from the present alloy if cost is an important consideration.

The present engine components, exhaust system components, etc. may be used with existing engine and exhaust assemblies or used in newly designed assemblies. Accordingly, the components can have the overall shape and gauge of conventional components. Of course the present components may also be prepared as thicker, or preferably, thinner gauge components if desired. The present metal alloy components may, however, be somewhat heavier in weight than an identical component made from aluminum or conventional stainless steel due to the greater specific gravity of the metal alloys used in the present invention.

The high temperature oxidation resistant materials which may be used in the present invention include any material which has sufficient strength and which can operate at temperatures of 1400° F., alternatively up to 1500° F. and higher. Suitable high temperature materials include high temperature alloys, ceramics, materials prepared by powder metallurgy, and metals coated with ceramics. Any physical structure capable of sufficient strength and continued operation at temperatures of 1400° F. and greater can be used as the high temperature resistant material of the present invention. Particularly preferred are high temperature metal alloys which have sufficient strength, temperature resistance and oxidation resistance.

Preferred alloys which may be used in the present invention are known and are superior to conventional stainless steels and aluminum in withstanding high temperature corrosion and oxidation. The present alloys have substantially greater nickel, which although costly, results in substantially improved tensile strength, yield strength and relatively low thermal expansion as well as superior oxidation resistance, as compared, for example, with SS 321. Particularly preferred are alloys having greater than or equal to about 15 wt. % nickel and which demonstrate high temperature resistance and oxidation resistance. However, any high temperature alloy which is capable of continued operation at temperatures of 1400° F. or greater can be used in the present invention.

A specific embodiment of the alloy of the present invention is a nickel-chromium-tungsten-molybdenum alloy which combines high temperature strength with resistance to oxidizing environments during prolonged exposure to high temperatures. The present alloy (Mallen Alloy) and SS 321 comprise the following components:

| Element | Present Alloy (wt. %) | SS 321 (wt. %) |
|---|---|---|
| carbon (C) | 0.05–0.15 | up to 0.08 |
| manganese | 0.3–1.0 | up to 2.0 |
| silicon | 0.25–0.75 | up to 1.0 |
| chromium | 20.0–24.0 | 17.0–19.0 |
| nickel | 47.5–57.2 | 9.0–12.0 |
| iron | up to 3.0 | Balance |
| molybdenum | 1.0–3.0 | — |
| tungsten | 13.0–15.0 | — |
| cobalt | up to 5.0 | — |
| aluminum | 0.2–0.5 | — |
| boron | up to 0.015 | — |
| lanthanum | 0.005–0.05 | — |
| titanium | — | 5 × C minimum |

The alloys which may be used in the invention are available, for example, from Haynes International, Windsor, Conn. and others.

The components of the invention can be fabricated using conventional processes known in the art for working and fabricating high temperature resistant materials and metal alloys. The materials may be formed into sheets, tubes, blocks, etc. and then further worked or machined to obtain the desired component configuration. Metallurgical processes such as powder metallurgy, casting, etc. may also be employed. These fabrication processes are well known to those skilled in the art of working with high temperature materials.

Figure 2A:
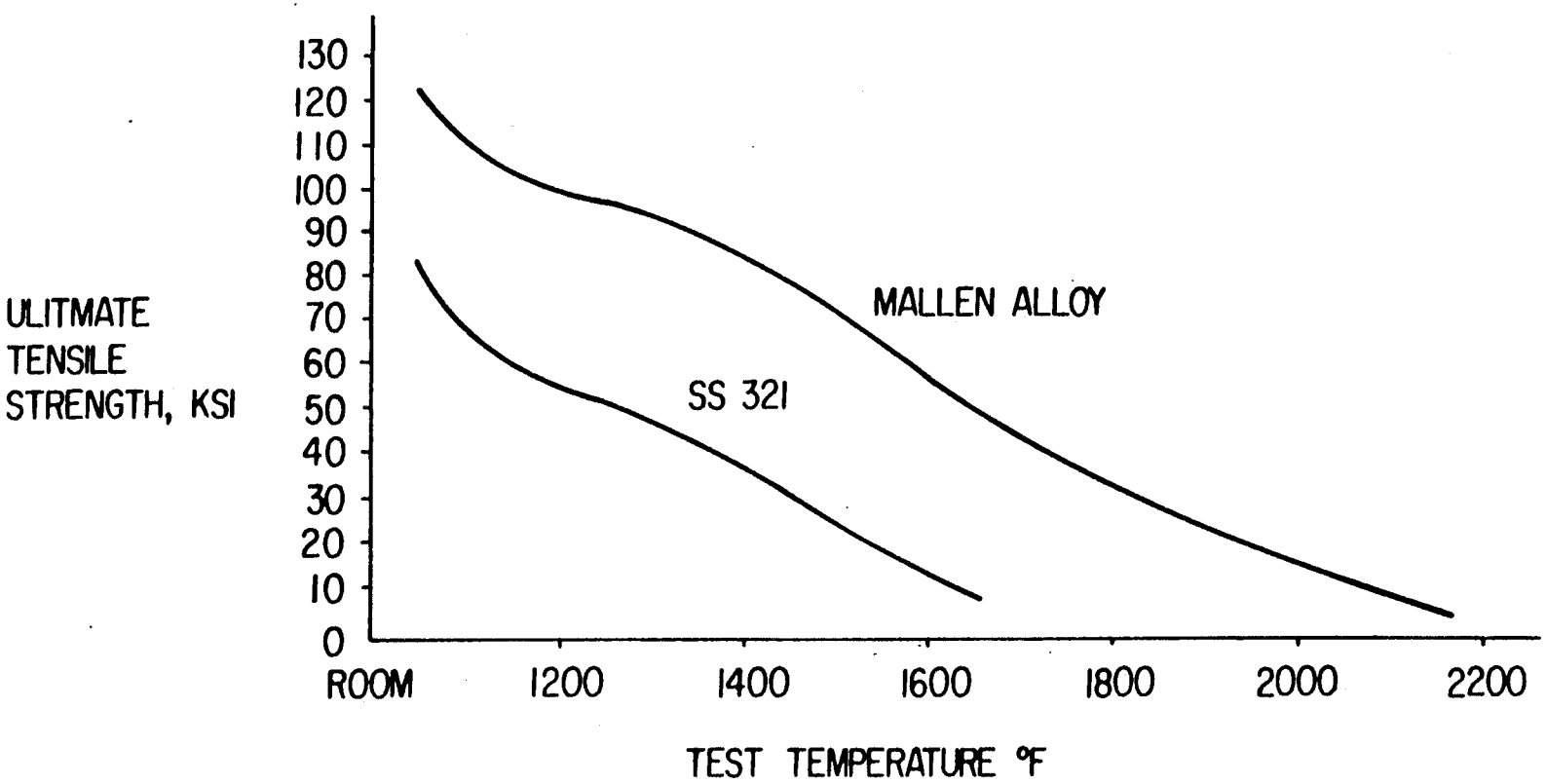
FIGS. 2(*a*) and 2(*b*) compare the tensile and yield properties of a preferred alloy used in the present invention and SS 321.
Figure 2B:
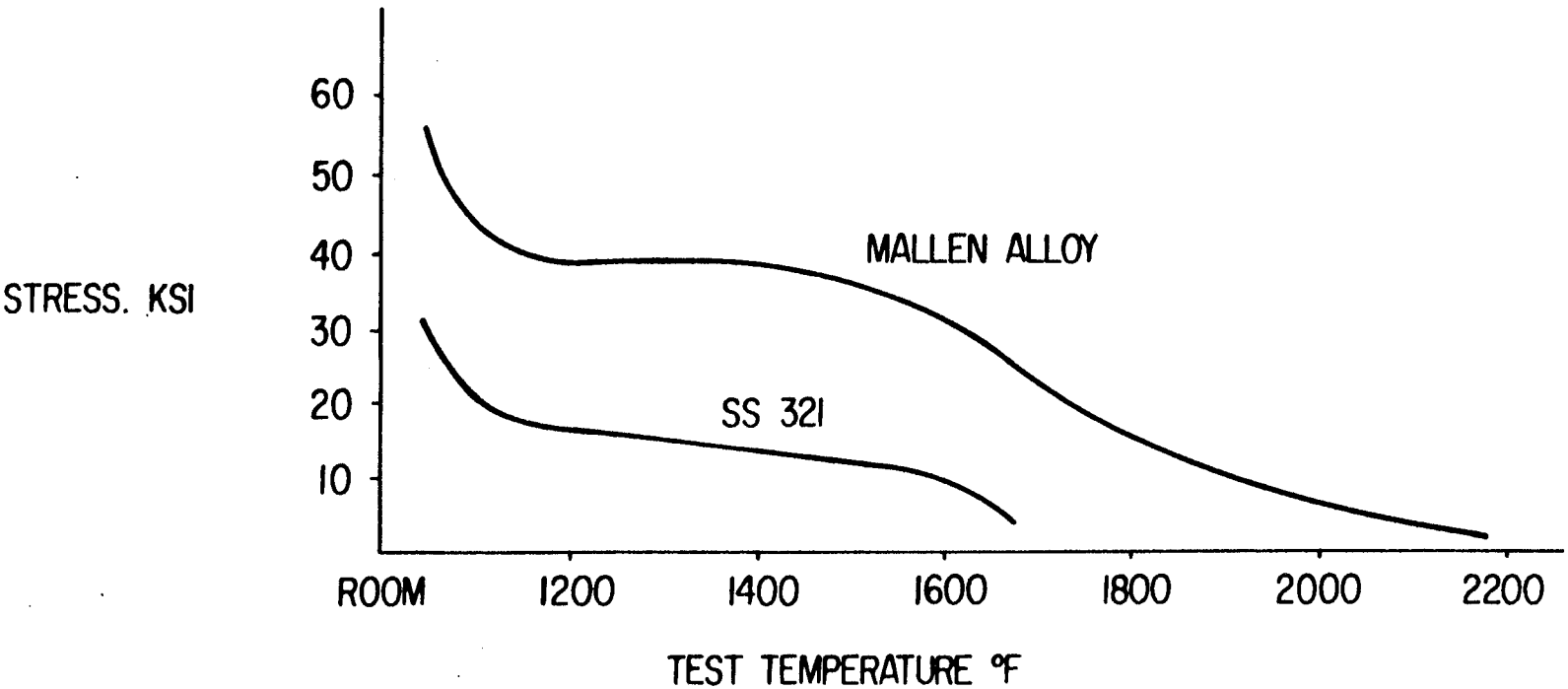
Figure 3:
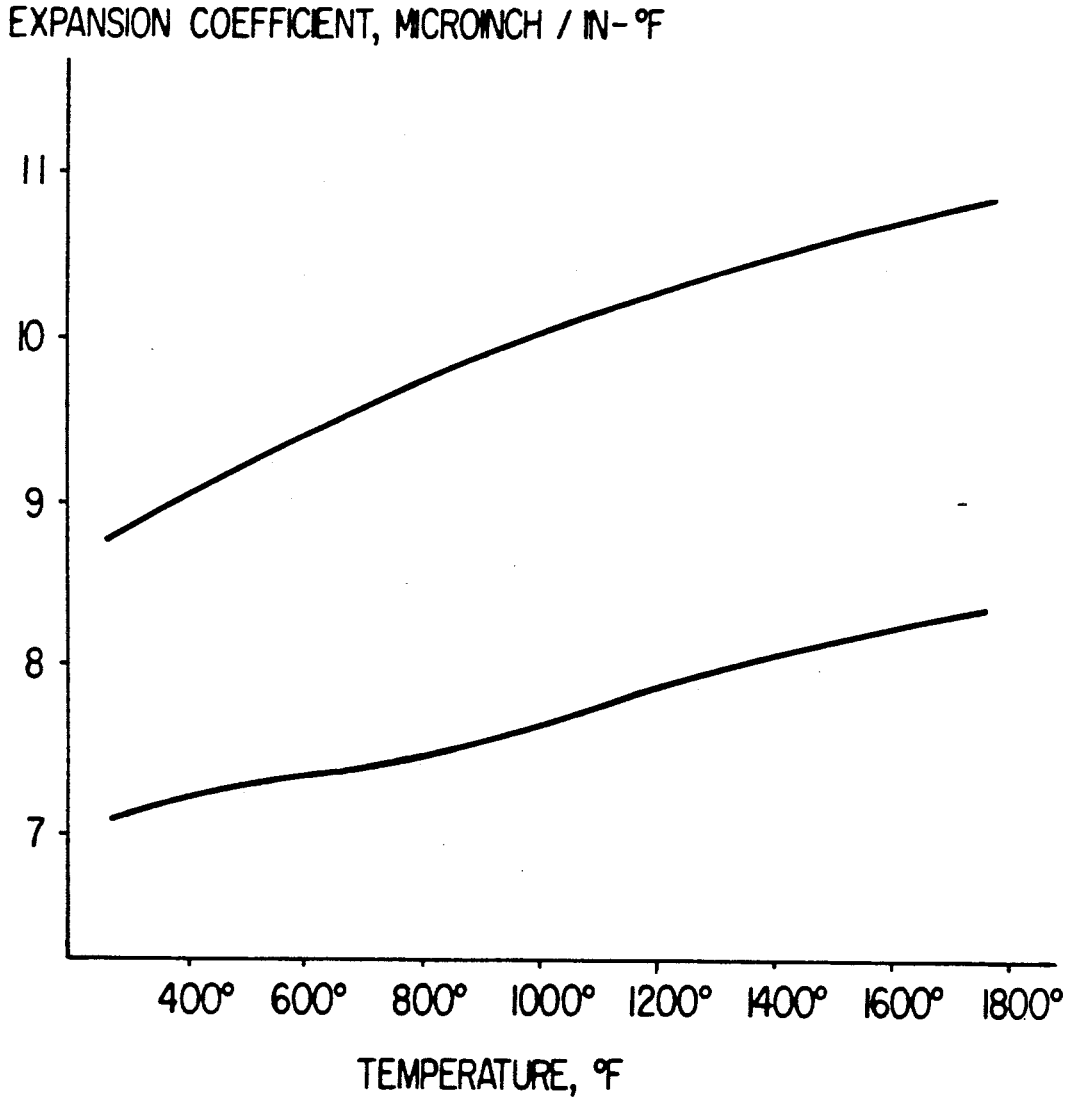
FIG. 3 compares the thermal expansion characteristics of a preferred alloy used in the present invention and SS 321.

The aircraft parts made of the above identified alloy have high temperature strength and resistance to oxidizing atmospheres during prolonged exposure up to temperatures of about 2100°–2200° F. In comparison, SS 321 is not recommended above 1500° F. The creep properties of the preferred alloys of the present invention are far superior to SS 321 and have a lifetime which is as much as 100 times longer than SS 321 for a comparable part of identical gauge (FIG. 1). Additionally, the tensile strength of the present alloys is about four times higher at 1500° F. than that of SS 321. For example, the tensile strength of the present alloy at 1700° F., a temperature at which SS 321 fails and becomes brittle, is equivalent to the tensile strength of SS 321 at a temperature of only 1250° F. as shown in FIG. 2. Additionally, the thermal expansion characteristics of the alloy parts of the present invention are lower by approximately 50% at 1400° F. relative to SS 321 (FIG. 3).

Figure 4:
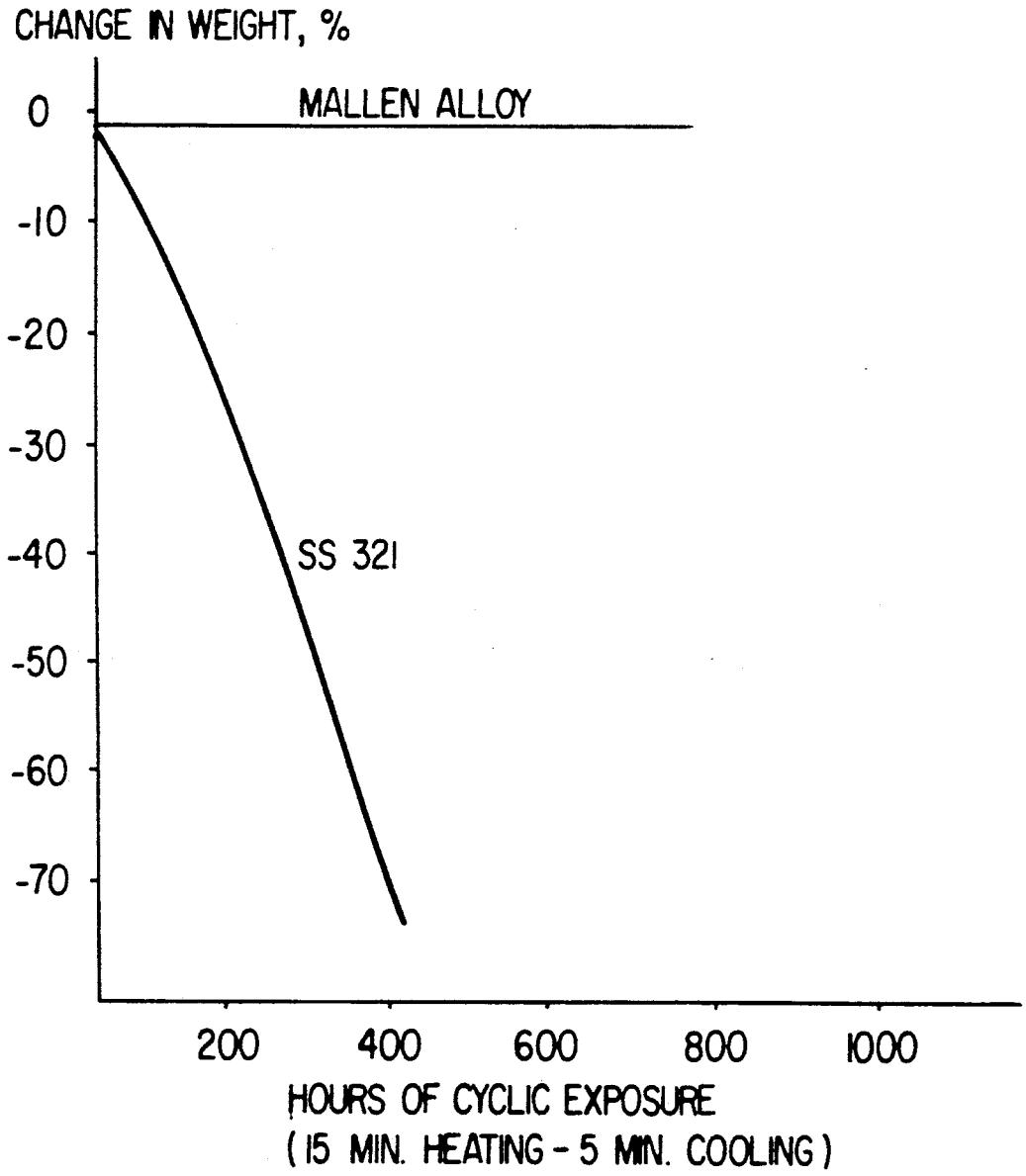
FIG. 4 compares the oxidation resistance of a preferred alloy used in the present invention and SS 321.

Oxidation results in scaling and material loss of engine and exhaust components, particularly at higher temperatures. Material loss results in lower strength and eventual component failure. The aircraft components of the present invention prepared from the materials described above have excellent resistance to gas and air oxidation. The preferred alloy parts of the present invention exhibits substantially zero weight loss at 1800° F. at cycling exposure times of 1000 hours as shown in FIG. 4. In comparison, SS 321 shows a 80% weight loss under identical conditions after only 400 hours. Components made from SS 321 effectively fail much earlier than 400 hours due to the vibration and cracking stress associated with actual use in aircraft.

Preferably, the parts of the present invention have a lifetime of at least 1,000 hours without the need for replacement. More preferably, the parts can operate at temperatures of 1400° F. and higher for 1,500 hours and even 2,000 hours or longer without the need for replacement. The substantially longer lifetime of the present components is a significant advantage in vehicle maintenance, particularly in aircraft which require regular and detailed maintenance.

Figure 5:
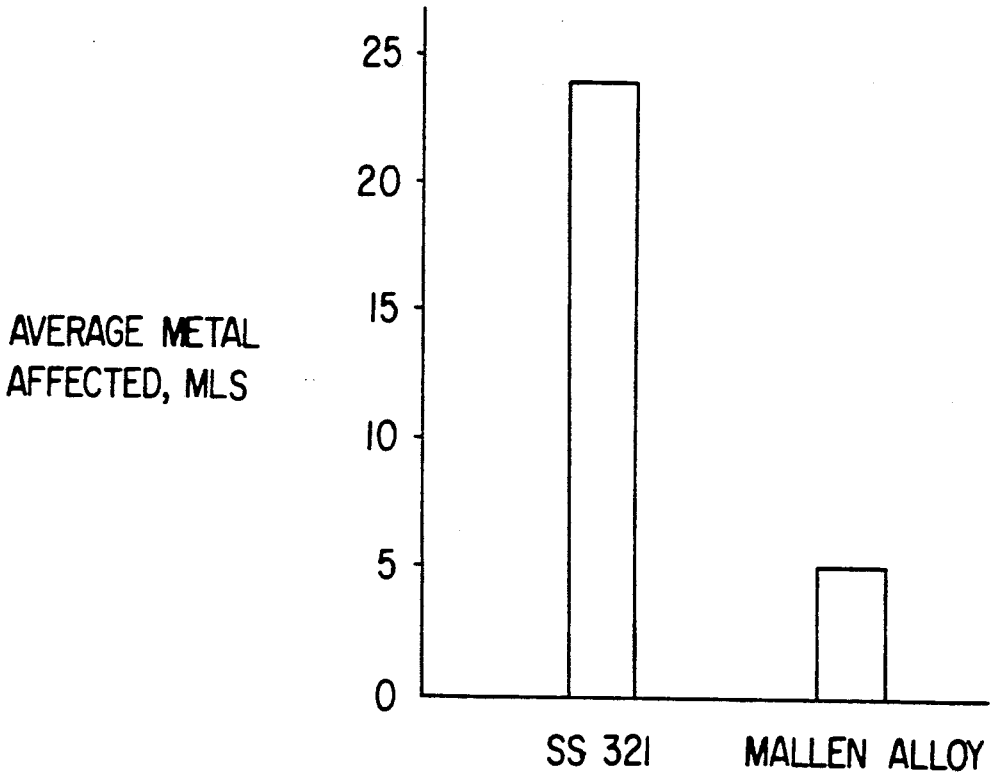
FIG. 5 compares the burner rig oxidation resistance of a preferred alloy used in the present invention and SS 321.
Figure 6:
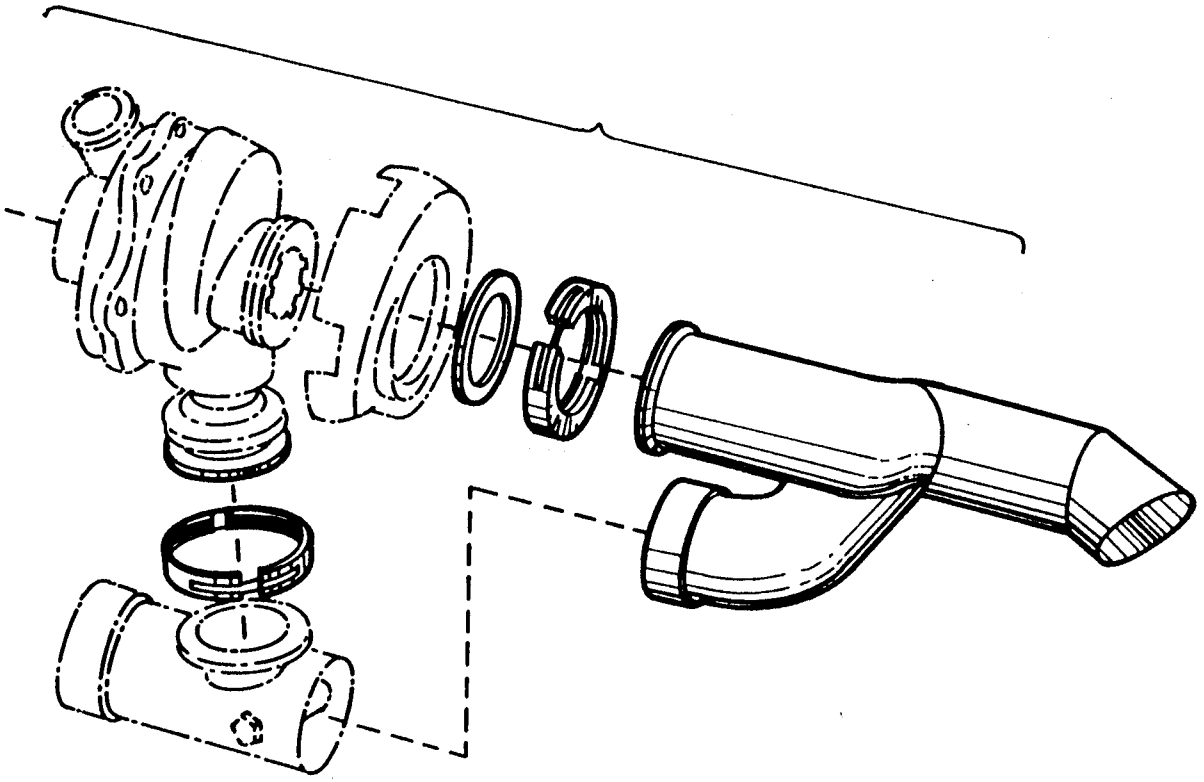
FIG. 6 shows an exploded schematic installation diagram for a preferred embodiment of the exhaust components of the invention.

As shown in FIG. 5, when subjected to a burner rig with periodic cooling at 2000° F. for 500 hours, the alloy components of the present invention lost only 5 mls (5/1000 inch) while SS 321 lost 23 mls. Conventional exhaust manifolds and tailpipes have a thickness of approximately 40/1000 inch. FIG. 5 demonstrates that after 500 hours, a conventional exhaust system component will have been reduced to less than one half its original thickness while the alloy components of the present invention still retain approximately 87.5% of the original thickness.

The engine components of the present invention have been flight tested for 25 hours in conventional aircraft. After use, the parts showed no visual oxidation, cracking, weight loss, destruction or aging even after exposure to exhaust gases having temperatures up to 1735° F. The components of the present invention are, therefore, superior to conventional components.

The components of the present invention are therefore superior engine and exhaust components for use in high temperature oxidizing environments on all positive displacement engines and in particular on turbocharged piston engines.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. In a method of preventing engine compartment fires in a positive displacement internal combustion engine or exhaust assembly, the improvement comprising:

fabricating at least one component of said positive displacement internal combustion engine or exhaust assembly from a high temperature oxidation resistant alloy consisting essentially of 0.05–0.15 wt. % carbon, 0.3–1.0 wt. % manganese, 0.25–0.75 wt. % silicon, 20.0–24.0 wt. % chromium, 47.5–57.2 wt. % nickel, up to 3.0 wt. % iron, 1.0–3.0 wt. % molybdenum, 13.0–15.0 wt. % tungsten, up to 5.0 wt. % cobalt, 0.2–0.5 wt. % aluminum, up to 0.015–0.05 wt. % lanthanum.

2. The method of claim 1, wherein said component is the firewall.

3. The method of claim 1, wherein said component is an engine component.

4. The method of claim 1, wherein said component is a valve, cylinder, piston, crankcase, bearing, exhaust port, turbocharger component, engine assembly clamp or engine assembly bracket.

5. The method of claim 1, wherein said component is an exhaust assembly component.

6. The method of claim 1, wherein said engine is turbocharged and said component is a turbocharger housing, wastegate, turbocharger exhaust pipe, a clamp or bracket for securing said turbocharger housing, wastegate or exhaust pipe to said engine.

7. The method of claim 1, wherein said engine is an aircraft engine.

8. The method of claim 5, wherein said exhaust assembly component is a manifold, tailpipe, exhaust pipe, turbocharger exhaust pipe, wastegate, exhaust assembly bracket or exhaust assembly clamp.

* * * * *